United States Patent [19]

Wyatt

[11] Patent Number: 4,559,670

[45] Date of Patent: Dec. 24, 1985

[54] ADJUSTABLE CARRIER ASSEMBLY FOR A VERTICAL LOUVER WITH SPACER LINK

[76] Inventor: James L. Wyatt, 2753 W. Temple St., Los Angeles, Calif. 90026

[21] Appl. No.: 551,663

[22] Filed: Nov. 10, 1983

[51] Int. Cl.[4] ..... E05D 13/02

[52] U.S. Cl. ..... 16/87.2; 160/177

[58] Field of Search ..... 16/87 R, 87.2, 87.4 R, 16/102; 160/166 R, 166 A, 167, 168, 174, 176 R, 177

[56] References Cited

U.S. PATENT DOCUMENTS

| | | | |
|---|---|---|---|
| 4,122,884 | 10/1978 | Salzmann | 160/168 R |
| 4,262,728 | 4/1981 | Debs | 160/176 R X |
| 4,282,631 | 8/1981 | Uehara et al. | 16/102 |
| 4,316,493 | 2/1982 | Arena | 160/168 R |
| 4,332,288 | 6/1982 | Frentzel et al. | 160/168 R X |
| 4,386,644 | 6/1983 | Debs | 160/174 |
| 4,425,955 | 1/1984 | Kaucic | 160/168 R |

FOREIGN PATENT DOCUMENTS

| | | | |
|---|---|---|---|
| 63265 | 10/1982 | European Pat. Off. | 160/166 A |
| 1581582 | 12/1980 | United Kingdom | 160/166 A |

OTHER PUBLICATIONS

Profile Industries Corp. (2 page brochure) showing their equalizing spacer PC-481, brochure copyrighted 11-1-82.

Profile Industries Corp. (4 page brochure) showing their Sun Pro vertical systems, brochure copyrighted Oct. 1981.

Graber Company; five pages of brochures showing the Nu-Vue free hang louvers and the Graberlite louver system.

Vertical Track Systems, 4 page brochure, system 4000 parts catalogue; Mar. 1, 1983.

*Primary Examiner*—Fred Silverberg

*Attorney, Agent, or Firm*—Jessup, Beecher & Slehofer

[57] ABSTRACT

A carrier is designed for holding and independently adjusting a hanging vertical louver. A plurality of carriers form a blind for creating privacy and modifying the amount of light transmitted through a window and into a room. The carriers are movable along the channels of an overhead rail which is installed at the top of the window casement. The louvers can be oscillated in a synchronized manner by rotating a splined shaft running through each carrier. Each carrier provides for adjustment of its supported louver to allow the face of the louver to be independently adjusted and reset vis-a-vis the window and the other louvers. There is another adjustment spacer for allowing the plurality of carriers, and therefore louvers, to be evenly spaced in a window casement having a non-standard width. The louver is securely but demountably attached to the carrier by a pendant member having a resilient pair of fingers. The pendant member allows the louver to hang vertically even when the headrail is not installed level.

5 Claims, 10 Drawing Figures

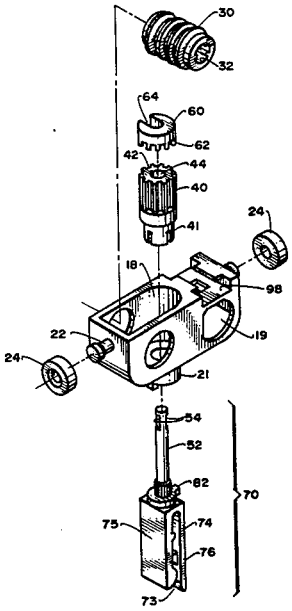

ADJUSTABLE CARRIER ASSEMBLY FOR A VERTICAL LOUVER WITH SPACER LINK

BACKGROUND OF THE INVENTION

Vertical louver system are well known in the art. They are typically installed as window or sliding door coverings. Whenever the window or sliding door is ajar, an occasional gust of wind can blow some of the louvers and cause a few of them to go out of alignment relative to the other louvers. Or on occasion, the user may wish to misalign the louver deliberately. There is an adjustment mechanism in the louver carrier for allowing the louver to be oscillated to change its alignment with respect to the other louvers. A clutch mechanism consisting of a cylindrical sleeve surrounding a concentric cylinder is provided to accomplish this. The surface of the concentric cylinder and the inside of the sleeve have tiny serrated teeth so that a certain amount of torque applied at the top of the louver, which is attached to the concentric cylinder will disengage the teeth and allow the louver to be detented to a new position, after which the teeth will reengage and will relock the louver in its new alignment. A spacer to equalize the spacing between louvers for a given installation is also known in the art. It consists of a band which is slideable on the spacer link. The spacer is fitted to the end of the spacer link and is then snapped into a recess in the carrier. It results in a one-quarter inch shorter spacing interval between two carriers.

SUMMARY OF THE INVENTION

A carrier for a vertical louver is supported by an overhead rail which is supported across the width of the upper casement of the window, or from the ceiling. The carrier has a pair of wheels for allowing it to ride back and forth in the rail and there is also a pinion rod or splined guide or rail along which the carrier can travel. The splined pinion rod has a crank means at one end of the head rail. By rotating the splined pinion rod, a worm gear inside of the carrier is also rotated. The carrier is further comprised of a plastic frame means holding the worm gear. The splined pinion rod, when rotated, will oscillate each of the vertical louvers synchronously, so that the face of each louver will be oscillated the same number of degrees. There is a vertical gear cooperating with the worm gear which also rotates whenever the worm gear is rotated. The vertical gear has an axial bore through which a vertical shaft is loosely fitted. The other end of this shaft has a securing means for holding one end of the vertical louver. The upper end of the vertical shaft has a pair of secant flats which act as a securing point for a slotted disk or crown. The vertical shaft maintains its position in the vertical bore of the gear by the slotted disk, which prevents the shaft from dropping out. The slotted disk has a plurality of teeth projecting from its underside which engage with the tooth spaces of the vertical gear. The purpose of this combination is to allow for the individual oscillation or adjustment of the vertical louver. This can be accomplished by pushing up on the pendant member, which disengages the teeth of the disk from the tooth spaces of the vertical gear. In this manner, the vertical louver can be adjustably oscillated up to 180 degrees. When the pendant member is released, the teeth of the disk reengage the tooth spaces of the gear, thereby relocking the vertical louver at a particular angular point in its oscillation path.

When the louvers are closed, sunlight may not be reflected enough by the louver faces. The purpose of this oscillation adjustment allows each louver to be angled individually to decrease or increase the amount of entering sunlight in a particular part of the room. The pendant member, which controls the vertical louver oscillation also has a longitudinal slot for holding the upper end of the slotted end of the louver. Each louver has a slot towards one end. The slot engages with the longitudinal slot of the pendant member for hanging the louver from the pendant member. The longitudinal slot has a snap feature having a ridge and a ledge for preventing the louver from inadvertantly disengaging from the slot.

When the carriers and louvers are drawn, or traversed, across the window, it is desirable that the carriers be substantially equally spaced in the casement of the window. When the louver system is installed in the framing of the window, elongate spacer links connected between each carrier provide equal spacing of the louvers on the head rail. However, because of the environment in which the louver system is installed, there oftentimes results in a small gap at the edges of the louver system. To increase the spacing between the louvers to eliminate this small gap, there are several bilateral projections at the end of each spacer link. These projections can be snipped off in increments to increase the effective length of each link by a fraction of an inch. This provides flexibility in spacing the louvers across the face of the window area.

When the head rail is installed in the upper casement of the window, from a wall or from a ceiling, occasionally the rail is not in a horizontal plane. The carrier will be offset the same amount as the rail, since the carrier rides in the rail. The pendant member which connects the louver to the carrier engages the axial bore in the vertical gear, and it has a split washer preventing it from falling out of the bore. There is enough clearance between the pendant member and the bore to allow the split washer end of the shaft to nutate near the upper end of the axial bore. This nutation allows the louver and pendant member to hang vertically, cancelling the offset of the carrier. Otherwise the louvers would hang in a haphazard fashion, depending upon the angle where each louver is preset, or the angle caused by the rotation of the splined pinion rod. All of the parts of the carrier are suited to be made in plastic.

Accordingly, it is an object of this invention to provide a system for hanging vertical louvers across a space which provides an individual oscillation adjustment setting for each louver independently of the other louvers, and thereafter the louver will oscillate synchronously with the other louvers while maintaining its previously set adjustment.

It is another object of this invention to provide a louver system which will hang in the true vertical even when the headrail is not installed precisely in a horizontal plane.

It is a further object of this invention to provide an elongate spacer link between each carrier holding a louver for incrementally increasing the spacing between each carrier to eliminate the occasional gap resulting between the end louver and the edge of the wall area or window casement to be covered when the louver system is initially installed.

DETAILED DESCRIPTION OF THE PREFERRED EMBODIMENT

Figure 1:
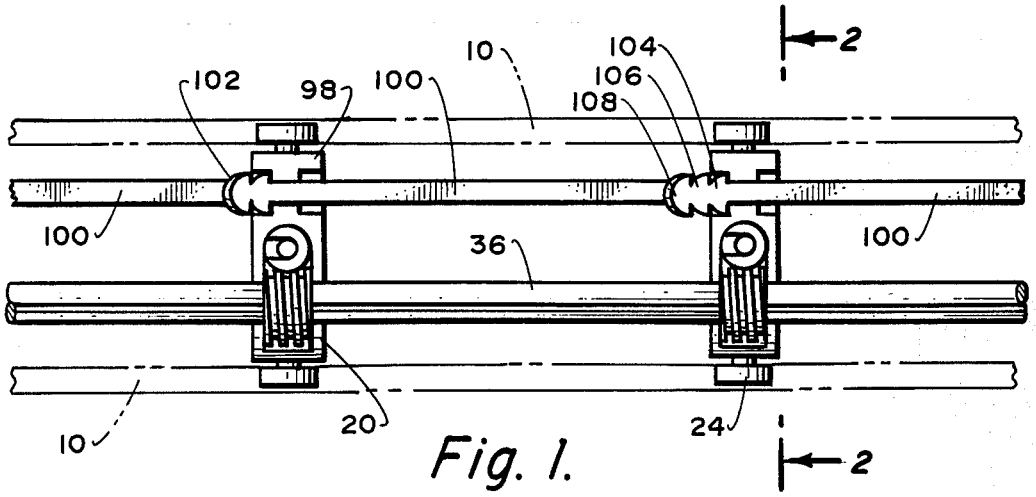
FIG. 1 is a top plan view showing two carriers connected by the spacer link and showing the headrail in phanthom lines.

FIG. 1 shows a top-plan view of two carriers in position in the head rail. The channels 10 of the head rail are shown in phantom lines. The elongate spacer links 100 are shown with the two carriers spaced apart the maximum distance allowed by the spacer links 100.

Figure 2:
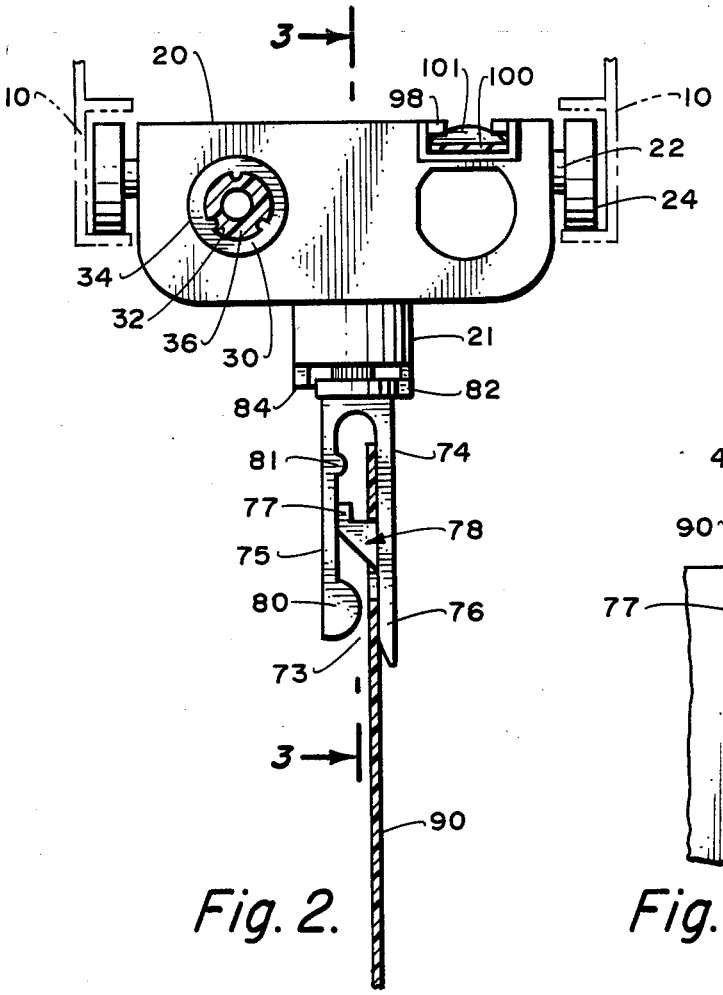
FIG. 2 shows a front elevational view of the carrier including the frame means, elongate pendant member, and a vertical louver, taken along line 2—2 of FIG. 1.

FIG. 2 is a front elevational view of the carrier riding in the channels 10 of the head rail. The carrier includes a frame means 20, shown in the form of a generally hollow rectangular housing having two compartments 18 and 19. The housing can be fabricated by a plastic injection molding process. On both exterior sides of the housing 20 are a set of spindles 22 for attaching a pair of wheels 24, which ride in the channels 10 of the overhead rail. The first compartment 18 of the housing 20 has circular openings 34 and 35 for allowing a rotatable mounting of a worm gear 30 between the openings 34 and 35. The cental bore 32 of the worm gear 30 is splined for receiving a splined pinion rod or shaft 36. The rod 36, along with wheels 24, provides alignment for the carriers 20 as the louvers are being traversed, that is, being drawn open or closed. The pinion rod 36 may be rotated by suitable crank means at one of its ends. Whenever the splined pinion rod 36 is rotated, the worm gear 30 also rotates. The rotation of the worm gear 30 causes the louver 90 supported by the carrier, to oscillate about its axis a given number of degrees, depending upon the number of times the splined pinion rod is rotated. Each louver in the system, in response to rotation of the pinion rod 36, oscillates in synchronism with the other louvers; that is, each louver 90 will oscillate about its axis the same number of degrees regardless of the preset orientation of the face of the louver 90.

The second compartment 19 of the housing 20 provides a passageway for a draw cord for drawing or traversing the carriers along the head rail to open or close the louver system. The underside of the housing 20 has a hollow cylindrical projection 21 for providing a passageway for the securing means 70 to pass into the first compartment 18 of the housing 20. The securing means 70 is in the form of an elongage pendant member having a vertical shaft means 52 at its upper end. The shaft means 52 is in the form of a vertical rod or shaft having a pair of secant flats 54 grooved therein near its upper end. There is a gear 40 which is rotatably mounted in the first compartment 18 of the housing 20. The gear 40 has a circular bearing surface 41 which fits in the passageway of the underside projection 21. The gear 40 mates with the worm gear 30 such that when the worm 30 rotates, the gear 40 also rotates. There is also included with the gear 40 a vertical axial bore 44 through which the shaft 52 passes rotatably. There is a disk or crown 60 in the form of a split washer comprising a ring having a radial passage 64. The washer 60 also has a plurality of teeth 62 projecting downward which can selectively engage with the tooth spaces 42 of the vertical gear 40. The split washer 60 engages the secant flats 54 on the vertical shaft 52. This connection retains the securing means 70 and prevents it from dropping out of the housing.

The shaft 52 is also vertically movable in the axial bore 44. The shaft 52 can be pushed upwards, which causes the teeth 62 to disengage from the tooth spaces 42 of the vertical gear 40. This disengagement allows the shaft 52 to oscillate or rotate, which in turn causes the louver 90 attached to the base of the shaft to also turn or oscillate. The purpose of the washer 60 and gear 40 combination is to provide a mechanism for individually setting the face of the louver 90 independently of the orientation of the other louvers. This step is accomplished by grasping the pendant member 74 with the thumb and forefinger, pushing up to disengage the split washer 60 from the tooth spaces 42, and turning the louver 90 while the teeth 62 are disengaged. After the face of the louver is properly oriented, the pendant member 74 is dropped down, which causes the teeth 62 to reengage with the spaces 42. The orientation of the louver is now reset, and whenever the pinion rod 36 is rotated the louver will turn or oscillate in a synchronized manner along with the other louvers in the system. The weight of the louver and pendant member keeps the teeth 62 and spaces 42 from disengaging.

Figure 7:
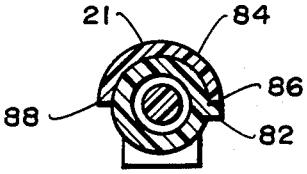
FIG. 7 is a cross-sectional view taken along line 7—7 of FIG. 4, indicating the 180 degree oscillation range of the louver. The position of the vertical louver is at its maximum closed position.
Figure 8:
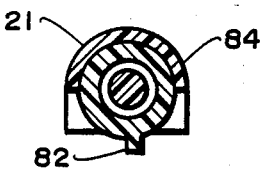
FIG. 8 shows the louver midway between its stop points; the louver is at a right angle to the head rail and this is the maximum open position of the louver.

The utility of this adjustment feature becomes apparent after the louver system is installed across a window opening. In the initial setting, the face of each louver is at a right angle to the window pane to allow for the maximum amount of sunlight to enter the room. FIG. 8 shows the position of the stop means or pin 82 when the louver setting is at the maximum. This is the point where the pin 82 is midway between the ends of the oscillation range. There is a partial ridge 84, which limits the movement of the pin 82 to an arc of 180 degrees. FIG. 7 shows the louver at its minimum opening. This would be the position where the face of the louver 90 is nearly parallel with the window pane. A 180 degree of arc allowed for the adjustment of the louver is sufficient to set the face of the louver at any angle relative to the window frame. When the pin 82 abuts edge 88 of the partial ridge, the back of the louver is facing the window pane, and when the pin 82 is abutting the edge 86, the face of the louver is facing the window pane. Although not shown, the louvers 90 have a convex face and a corresponding concave back. The pinion rod 36 is rotated by a pulley fitted to one end thereof, and a hanging circular chain fits in the groove of the pulley. The pulley can be rotated about six revolutions to fully close the louvers, and it can be rotated in the opposite direction six times to fully open the louvers. The rotation of the pulley is accomplished by pulling on the hanging chain.

When the louver system is installed across a window opening, the amount of sunlight allowed to enter the room is dependent upon the orientation of the face of each louver relative to the window pane. If the face of each louver is oriented in a parallel plane relative to the others, then when the pulley chain is pulled, the louvers will open and close in a sychronized and uniform manner. The amount of light entering the room should be the same across the face of the louver system since each louver is cracked open the same amount.

The individual setting adjustment for each louver previously described allows the occupant of the room to modify the amount of light entering particular areas of the room, as where for example, he or she wishes to have more light near desk areas or less light near hanging plants. The individual adjustments also allow for the blocking of the early morning or evening sun.

The occupant can preset each louver and thereafter leave the settings as is. When the pinion rod is rotated, each louver will move in a synchronous fashion and still retain its orientation relative to the other louvers. This allows the occupant to preset the system to block out the morning and evening sun. As the sun rises, the occupant merely pulls the pulley chain to change the orientation of all the louvers to compensate for the incresed light intensity as the day wears on to keep the room cooler. The range of oscillation of the louver system as a whole will be decreased by the differential in setting between the louvers which are offset the most.

Figure 10:
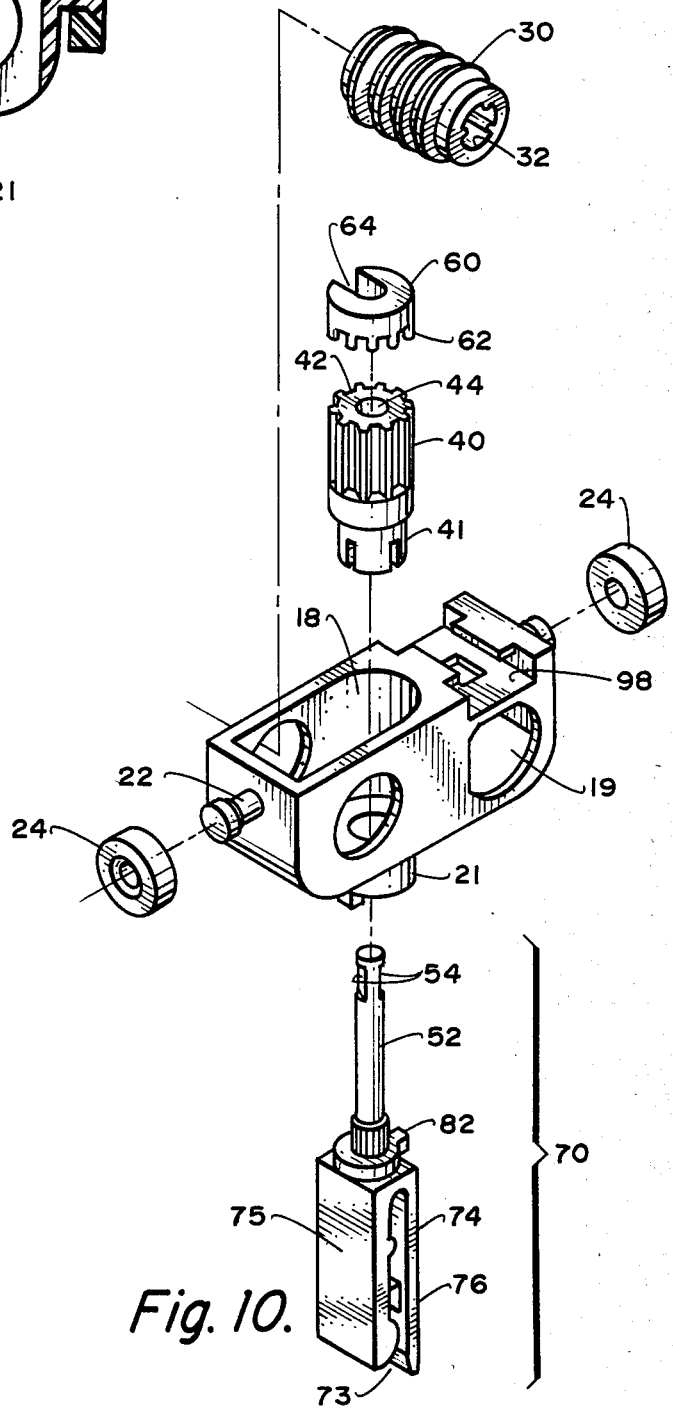
FIG. 10 is an exploded perspective view showing the components of the carrier sans the vertical louver.

FIG. 10 shows a securing means 70 in the form of an elongate pendant member 74 which forms the lower half of the securing means. The upper portion of the securing means is the vertical shaft 52. The purpose of the elongate member 74, shown in FIG. 2, is to secure the vertical louver 90 pendant from the shaft 52. The member 74 is made of resilient material such as plastic and it has a longitudinal slot 73 forming a pair of parallel fingers 75 and 76 One of the fingers 76 has a ledge 78 extending substantially across the slot 73, and it also has an upwardly extending ridge 77 on the edge of the ledge 78 adjacent to the other finger 75. The other finger 76 has a boss 80 at its tip and extending into the slot 73 below the ledge 78. The purpose of the pair of fingers 75 and 76 is to provide an anchor point when the louver 90, which has a louver slot 92, is inserted into the longitudinal slot 73 of the pendant member 74. The louver slot 73 is hooked over and behind the ridge 77 and is thus held in place suspended from the member 74. The resiliency allows the pair of fingers 75 and 76 to be spread apart when the louver 90 needs to be inserted or removed from the pendant member 74. There is also a small node 81 on the inside of the finger 75 for helping to retain the louver and to prevent it from falling out of the louver slot 92.

Figure 3:
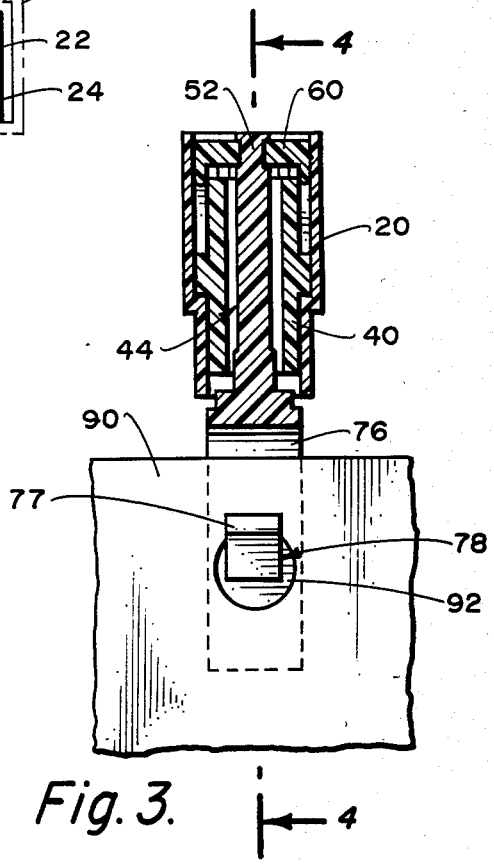
FIG. 3 is a cross-sectional view of the elongate pendant member and a fragmentary view of the vertical louver taken along line 3—3 of FIG. 2.
Figure 4:
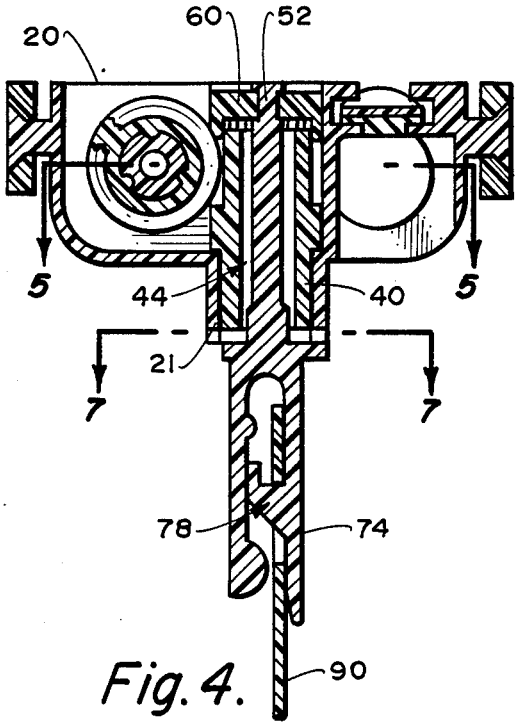
FIG. 4 is a vertical cross-sectional view of the carrier taken along line 4—4 of FIG. 3.
Figure 5:
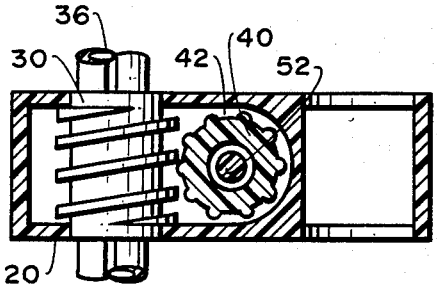
FIG. 5 is a cross-sectional view of the carrier taken along the line 5—5 of FIG. 4.
Figure 6:
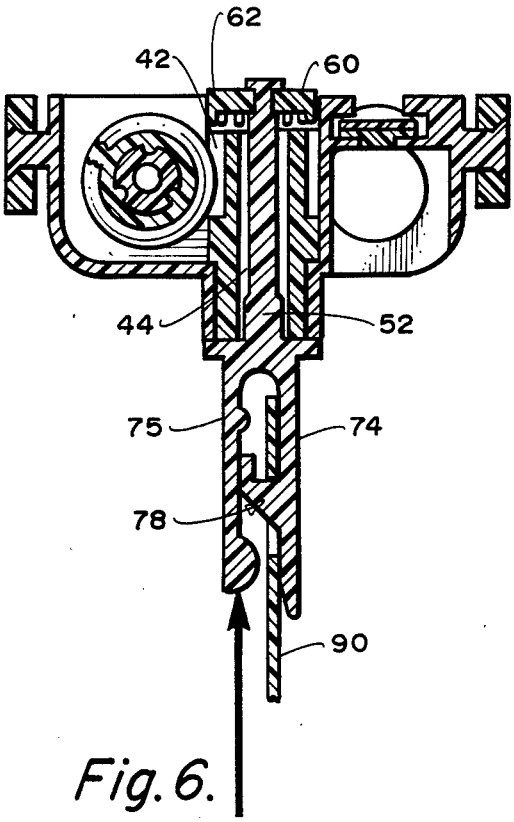
FIG. 6 is a cross-sectional elevational view of the carrier indicating by the arrow that the pendant member is pushed upwardly to disengage the disk from the tooth spaces of the gear in order to adjust the oscillation angle of the vertical louver.

FIG. 4 is a vertical cross-sectional view taken along line 4—4 of FIG. 3, showing the louver in the closed position as shown in FIG. 7, where the stop means 82 is at the 0 degree arc in its oscillation range of 180 degrees.

Figure 9:
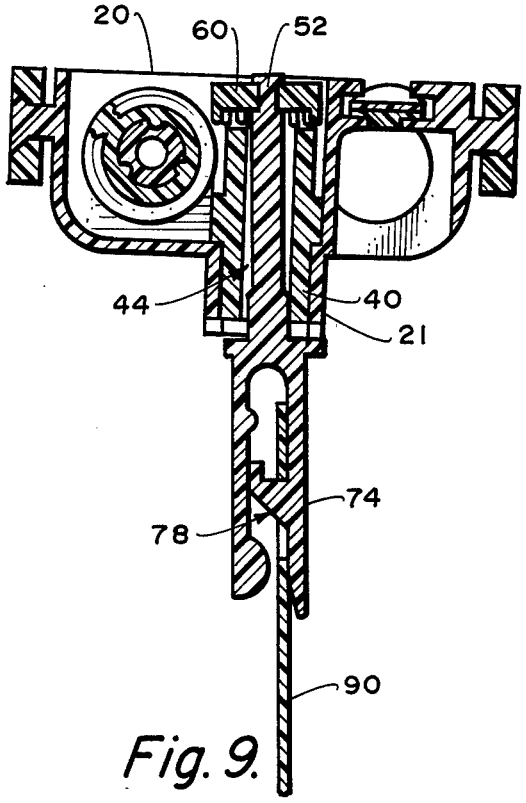
FIG. 9 is an elevational cross-sectional view of the carrier showing the vertical hanging of the vertical louver even when the head rail and carrier are not positioned precisely horizontal.

FIG. 8 shows the louver is in its fully open position. By rotating another 90 degrees the louver is in a closed position again, where the stop butts the edge 88 of the partial ridge. The louver system is normally installed in one of three ways; the head rail may be installed in the upper casement of a window framing; attached to a set of brackets extending from a wall surface; or attached to the ceiling. The head rail is supposed to be installed with its flat upper surface in a horizontal plane. Through careless workmanship, the head rail may be installed without being in a horizontal plane, and the channels 10 are not horizontal. This in turn causes the carrier 20 to ride tilted in the two channels 10. FIG. 4 is a cross-sectional view of the normal pendant relationship between the hanging louver and the carrier 20 when the head rail is level. FIG. 9 discloses the other situation where the head rail is not level after installation. The carrier is tilted a few degrees. The louver will hang improperly, and the entire louver system will look askew.

To provide a means for allowing the louver and pendant member to hang vertically even when the head rail is not precisely level, there is a clearance between the vertical shaft 52 and the axial bore 44 of the vertical gear 40. Some free play between the teeth and the tooth spaces 42 of the gear 40 permit the disk 60 to rock back and forth above the gear 40. The disk 60 is rigidly attached at the upper end of the vertical shaft 52 by mating with the secant flats 54. The diameter of the axial bore 44 is sufficiently larger than the diameter of the shaft 52 to permit limited nutation of the shaft within the bore and allow the shaft to hang vertically from the carrier even when the bore 44 may be offset slightly from the vertical. Additionally, the louver slot 92 allows the louver to hang freely from the ledge 78. When the pinion rod 36 is rotated to change the orientation of the louver 90, each vertical shaft 52 will nutate as the vertical gear 40 is slowly being turned by the worm gear 30. The teeth 62 of the disk or crown 60 still are able to engage the tooth spaces 42. The disk prevents the shaft from falling out of the carrier, and serves as the apex point from where the shaft nutates. Because of the aforementioned clearances, the vertical shaft 52, pendant member 74 and louver 90 combination hang truly vertical from the disk 60, provided that the carrier is not tilted excessively.

FIG. 1 shows two carriers 20 connected by an elongate spacer link 100. In operation, the louver system has several carriers 20 riding in the channels 10 for hanging a like number of louvers. The carriers are moved by pulling a draw cord strung through the passages 19 in each carrier. The pinion rod 36 must first be turned to oscillate the louvers to the fully open position, so that the carriers can be stacked next to one another when the louver system is drawn open. When the louvers are drawn closed by the cord, the first carrier of the stack is pulled away from the second carrier. The link 100 is secured at its base to its respective carrier as shown at 101 in FIG. 2. There is a passage or groove 98 of sufficient width and clearance to provide for a slidable fit with the link of the next carrier along the stack. The first carrier will be drawn away from the stack until it reaches the end 102 of its link with the next carrier. The end 102 has projections which hook the groove 98 so that the link will not separate from the next carrier. The first carrier continues being drawn out while it is being trailed by the rest of the carriers. Each carrier is separated by the distance between the end of the link 100 to the first projection of the lateral projections. In the embodiment shown in FIG. 1 the distance to projection 104 is $2\frac{3}{4}$ inches, to projection 106 is $2\frac{7}{8}$ inches, and to projection 108 is 3 inches.

A typical louver system has a 3 inch spacing between the midpoints of the carriers, and a louver width of $3\frac{1}{2}$ inches, to provide a $\frac{1}{4}$ inch overlap at each end of the louver when they are rotated to their closed position. In the ideal situation, the width of the opening where the louver system is to be installed should be a multiple of 3 inches so that there would be no surplus nor shortage of louvers when the system is installed. There usually is a gap or overlap of up to 3 inches between the last louver and the casement edge. Either way, the appearance of the louvers is not pleasing. The projections 104, 106 and 108 give the installer the flexibility of changing the spacings between some of the carriers to spread out the louvers substantially evenly along the casement. By snipping off projections 104, the spacing is increased by $\frac{1}{8}$ inch. By snipping off projections 106, the spacing is increased another $\frac{1}{8}$ inch. The installer has the option of selecting which louvers are to be given the extra spacing to fit the particular installation. After the job is finished, the louvers fit snugly against the edges of the casement of the window when the carriers are traversed across the headrail and appear to be uniformly spaced, even thoough some may be spaced apart an extra $\frac{1}{8}$ inch.

While the present invention has been shown and described herein in what is conceived to be the best mode contemplated, it is recognized that departures may be made therefrom within the scope of the invention, which is therefore not limited to the details disclosed herein, but is to be afforded the full scope of the claims.

What is claimed is:

1. Carrier for vertical louver, comprising:

frame means adapted to slide horizontally along a splined pinion rod;

worm means rotatably mounted on said frame means and having a central bore through which the pinion rod is adapted to pass;

a gear rotatably mounted on said frame means having a vertical axial bore, a plurality of tooth spaces and mating with said worm means;

vertical shaft means passing rotatably through said gear bore;

securing means on the lower portion of said shaft means for holding a vertical louver;

a separate disk secured to said shaft means above said gear, having at least one tooth projection downward and selectively engageable with at least one of the tooth spaces of said gear;

said shaft means being vertically slidable within said bore;

whereby said shaft means and said disc are adjusted relative to the carrier and the gear by moving said shaft means upwardly in a vertical direction to disengage said at least one tooth from said at least one of the tooth spaces, then rotating the shaft means and said disc relative to the gear, and then vertically moving said shaft means downwardly to selectively engage said at least one tooth with another one of the tooth spaces;

said disk comprises a split washer comprising a ring having a radial passage;

said shaft means having secant flats grooved therein on opposite sides of said shaft means, spaced axially inward from the end of said shaft means;

said washer being positioned around said shaft means, with said flats engaging the sides of said radial passage.

2. Carrier in accordance with claim 1, wherein:

the diameter of said bore is sufficiently larger than that of said shaft to permit limited nutation of said shaft within said bore;

whereby said shaft means may hang vertically from said frame means even tho said bore may be offset slightly from vertical.

3. Carrier in accordance with claim 1, including:

an elongate spacer link projecting from said frame means and adapted to slidingly pass thru a passage in an adjacent carrier;

said link having a plurality of lateral projections spaced along the length thereof adapted to engage the adjacent carrier, and limit the distance that said carrier can be separated from the adjacent carrier;

whereby said distance may be selectively determined by severing predetermined projections.

4. Carrier in accordance with claim 1, wherein: said securing means comprises an elongate pendant member made of resilient material and having a longitudinal slot forming a pair of parallel fingers;

one of said fingers having a ledge extending substantially across said slot, and an upwardly extending ridge on the edge of said ledge adjacent to other finger;

the other of said fingers having a boss extending into said slot below said ledge;

whereby a vertical louver having a slot may be inserted into the slot in said member and said louver slot hooked over and behind said ridge and thus held in place suspended from said member.

5. Carrier in accordance with claim 1, including stop means for limiting the oscillation of said shaft means.

* * * * *